United States Patent [19]

Mulligan

[11] 4,411,043

[45] Oct. 25, 1983

[54] TRAVELING PNEUMATIC CLEANER WITH REVERSING ARRANGEMENT

[75] Inventor: William L. Mulligan, Charlotte, N.C.

[73] Assignee: Parks-Cramer Company, Charlotte, N.C.

[21] Appl. No.: 364,967

[22] Filed: Apr. 2, 1982

[51] Int. Cl.[3] ..... A47L 5/14

[52] U.S. Cl. ..... 15/312 R; 15/319

[58] Field of Search ..... 15/312 R, 312 A, 319, 15/316 R, 316 A

[56] References Cited

U.S. PATENT DOCUMENTS 3,011,204 12/1961 Holtzclaw ..... 15/312 A 3,714,676 2/1973 Sloan ..... 15/319 X 4,258,450 3/1981 Sohler ..... 15/312 A

*Primary Examiner*—Chris K. Moore

*Attorney, Agent, or Firm*—Bell, Seltzer, Park & Gibson

[57] ABSTRACT

A traveling pneumatic cleaner and apparatus for cleaning textile mill rooms in which a control arrangement for reversing the direction of rotation of a tractor drive motor and thus the direction of movement of the traveling cleaner includes circuits for interrupting operation of the tractor drive motor for a predetermined short interval of time sufficient to permit the traveling cleaner to coast to a standstill before reversal of its direction of movement along the track way.

6 Claims, 6 Drawing Figures

TRAVELING PNEUMATIC CLEANER WITH REVERSING ARRANGEMENT

FIELD AND BACKGROUND OF INVENTION

Traveling pneumatic cleaners such as those illustrated, by way of example, in prior U.S. Pat. Nos. 3,304,571; 3,429,745; and 3,437,520 have achieved wide acceptance in the textile industry as accomplishing highly desirable improvements in the operation of the textile machines being cleaned and in the working environment for operators of those machines. As installed for use, such traveling pneumatic cleaners often operate over a plurality of textile machines, along circuits defined by track ways. In designing track way layouts for specific installations, it is frequently desirable to have a specific track way define a closed circuit for travel over a group of textile machines. However, in some installations it is necessary to have a track way layout which is other than a closed loop. Additionally, in closed loop installations it is necessary, from time to time, to prevent a traveling cleaner from passing over a specific textile machine.

In meeting these requirements for the use of traveling cleaners in textile mills, such cleaners have heretofore been provided with reversing arrangements. Typically, electrical power supplied to a tractor motor for the traveling cleaner has been delivered through a multiple pole switch. Switch actuating mechanism has been provided in order that, upon impacting a permanent or temporary bumper, the switch may be changed so as to immediately reverse the direction of rotation of the tractor drive motor.

While traveling pneumatic cleaners which accomplish reversing of the direction of travel in the manner just described have operated quite successfully, it has become apparent that the sudden reversal of the direction of travel of a tractor drive motor imposes electrical and mechanical strains on the traveling pneumatic cleaner drive arrangements. As persons knowledgeable in the design and use of electrical drive arrangements will appreciate, the sudden reversal of the direction of rotation of an electrical motor following impact of the relatively massive traveling cleaner with a bumper stop results in significant electrical current demands and in the imposition of significant mechanical forces on the structure of the cleaner.

BRIEF DESCRIPTION OF INVENTION

With the foregoing in mind, it is an object of the present invention to accomplish reversal in the direction of travel of a traveling pneumatic cleaner as used in textile mills while minimizing electrical power demands and mechanical stress imposed upon the traveling cleaner. In realizing this object of the present invention, an arrangement is provided in which reversal of the direction of travel of a traveling cleaner of the type described occurs through a sequence of first discontinuing the drive in a first direction, then braking the travel of the cleaner in that direction to slow the cleaner smoothly, and then reversing the direction of travel of the cleaner. By means of such a "soft" stop and reversal, the stress and strain imposed in prior arrangements is entirely avoided.

DETAILED DESCRIPTION OF INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 1:
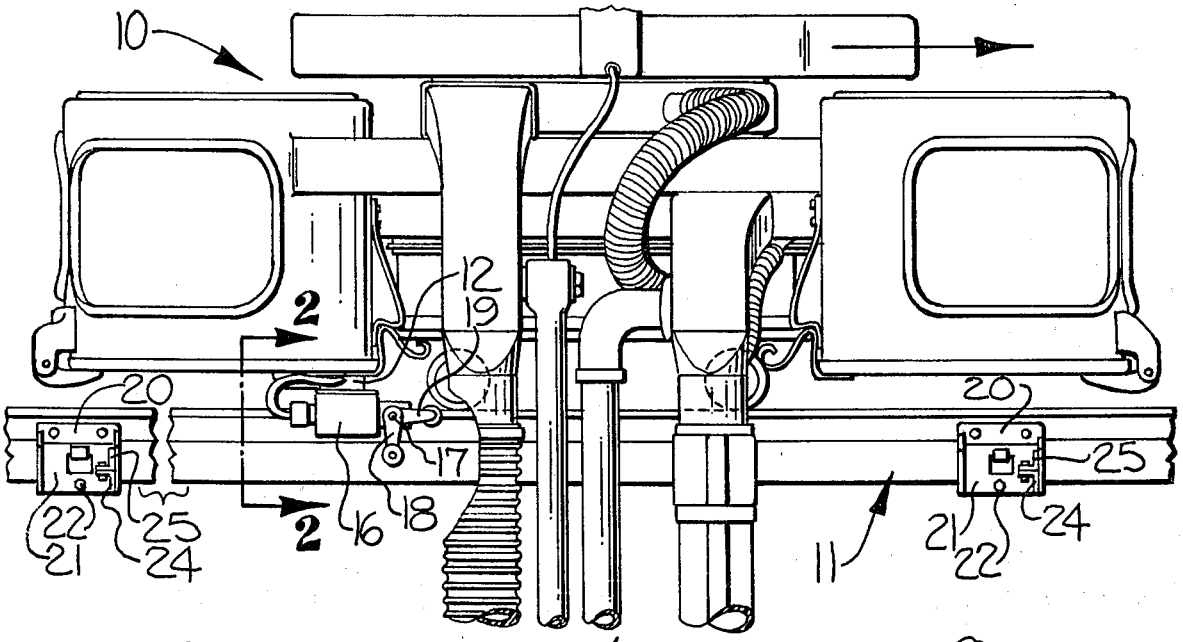
FIG. 1 is a side elevation view of the traveling cleaner in accordance with the present invention, moving along a track way.

Referring now more particularly to the accompanying drawings, the traveling pneumatic cleaner illustrated in FIG. 1 has substantial similarity to certain of those traveling pneumatic cleaners described and protected by the United States patents referred to hereinabove. To any extent necessary for an understanding of the present invention, the disclosures of those prior U.S. patents are hereby incorporated by reference. The traveling pneumatic cleaner, generally indicated at 10 in FIG. 1, is supported on a track way generally indicated at 11 for movement therealong. One direction of movement along the track way 11 is indicated by an arrow in FIG. 1. As wll be understood, the direction of travel of the traveling pneumatic cleaner 10 may be reversed, in accordance with the present invention. The traveling pneumatic cleaner is driven in movement along the track way 11 by a tractor motor, indicated at 12 in FIG. 5. Additionally, the cleaner 10 has a fan drive motor 14 and an updraft drive motor 15, the operation of which is of no major significance with regard to the present invention.

In order to accomplish reversal of the direction of travel of the traveling cleaner 10 in accordance with the present invention, a limit switch 16 is mounted on the traveling cleaner 10 for movement therewith. The limit switch 16 is of a type actuated by a rotary movement and switchable between two closed contact positions. For accomplishing such switching, an actuation shaft 17 extends from the limit switch 16 and has mounted thereon a pair of switch actuation arms 18, 19. As will become clear from the discussion hereinafter, each of the switch arms 18, 19 is rotated through 90 degrees of rotational travel upon engagement thereof with reversing trips mounted along the track way 11 as now to be described.

Figure 3:
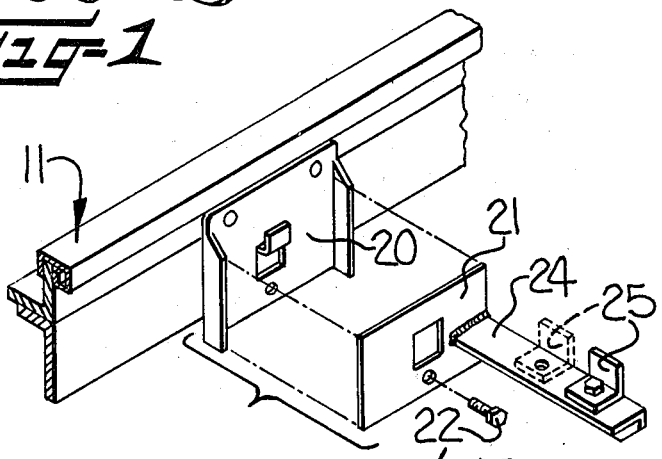
FIG. 3 is an exploded perspective view of a reversing trip of a first type in accordance with the present invention.

At appropriate points along the track way 11, such as between adjacent textile machines spanned by the track way or adjacent the end of a circuit as described hereinabove, mounting brackets 20 are secured to the track way 11 for receiving a selected one of two types of reversing trip means. A first type of reversing trip is indicated in FIG. 3, where a mounting plate portion 21 is configured to engage with the bracket 20. Upon engagement with the bracket 20, the reversing trip may be secured in place by an appropriate fastener such as a bolt 22. Extending from the plate 21 is a trip arm 24 on which may be mounted a reversing projection 25. As indicated in FIG. 3, the reversing projection 25 may be located in one of two positions, with the choice depending upon the direction of travel of the traveling pneumatic cleaner 10 as the cleaner approaches the reversing trip.

Figure 2:
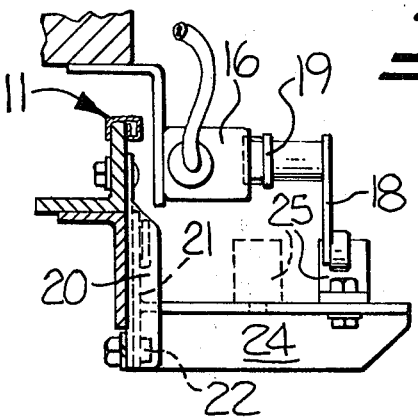
FIG. 2 is an enlarged elevation view, partially in section, along the line 2—2 in FIG. 1.

That is, assuming that the trip toward the right hand end of the track way 11 in FIG. 1 is arranged as shown in FIGS. 3 and 2, then, upon the traveling cleaner 10 traversing the location of the reversing trip, the switch arm 18 would be engaged by the projection 25 and the shaft 17 would be rotated through 90 degrees of rotation. With such rotation, certain changes in the drive for the tractor motor 12 occur, as described more fully hereinafter.

Figure 4:
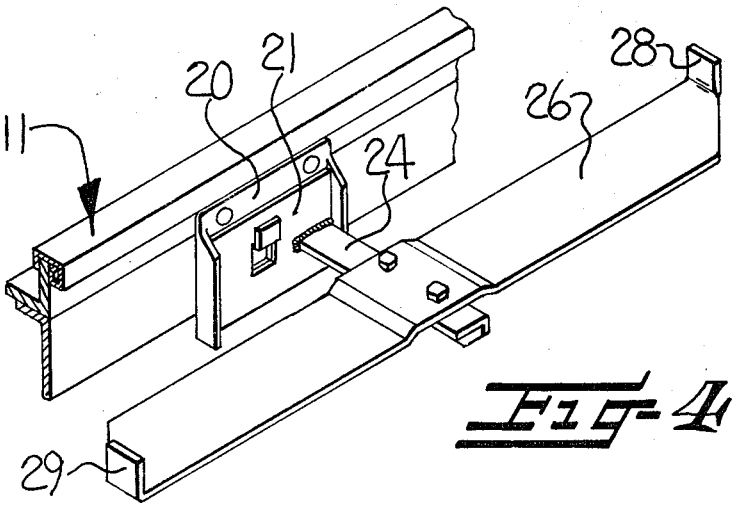
FIG. 4 is a view similar to FIG. 3, showing a second type of reversing trip in accordance with the present invention.

As will be understood, the reversing trip shown in FIGS. 1 through 3 is appropriate for many locations along a track way circuit, particularly where the direction of travel of the traveling pneumatic cleaner is known. Another form of reversing trip, illustrated in FIG. 4, is adaptable for use at other locations on a traveling cleaner circuit or at locations where the direction of travel of the traveling pneumatic cleaner 10 may be uncertain. As illustrated in FIG. 4, a plate 26 is provided which forms a pair of upstanding projections 28, 29 which thus will effect reversal in the direction of movement of the traveling cleaner 10 upon the cleaner approaching the reversing trip of FIG. 4 from either direction.

Figure 5:
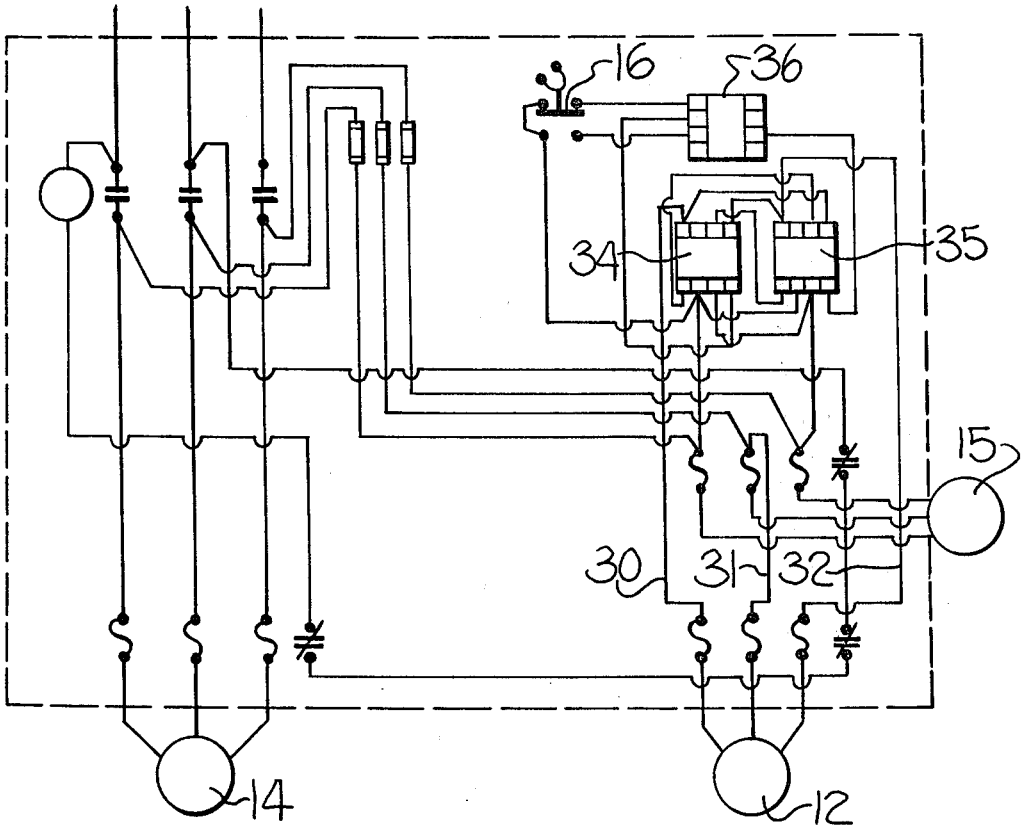
FIG. 5 is a first schematic wiring diagram, illustrating certain components of the traveling cleaner of FIG. 1.
Figure 6:
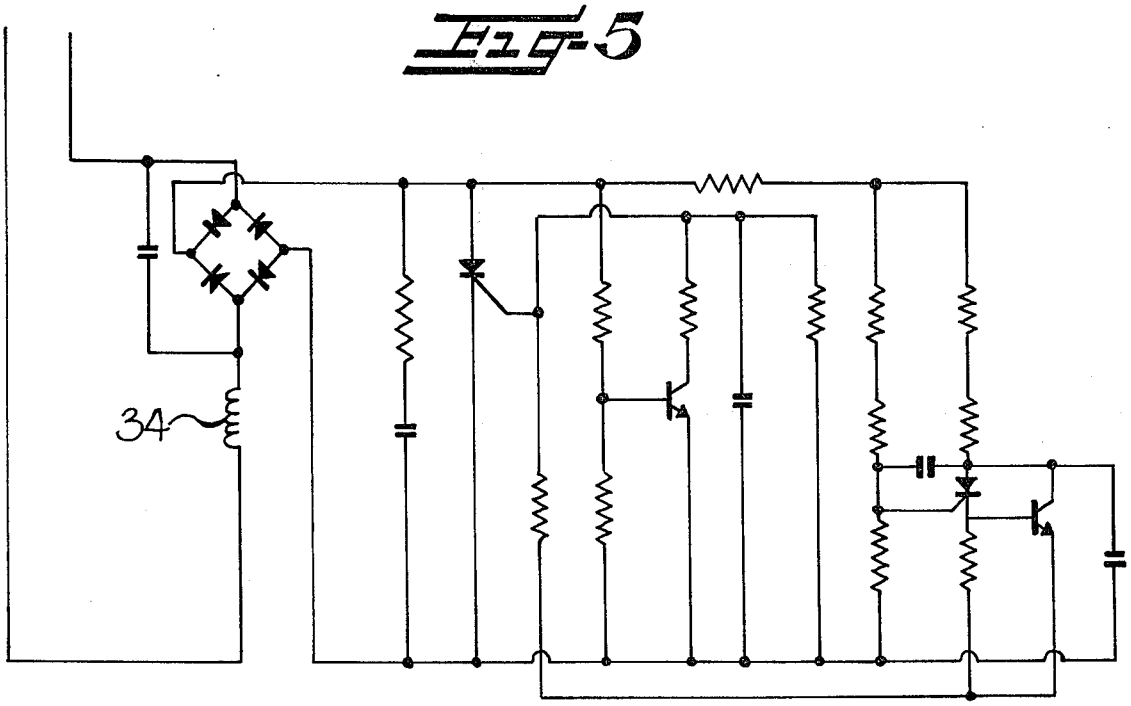
FIG. 6 is a schematic representation of one circuit component incorporated in the arrangement of FIG. 5.

Referring now more particularly to FIGS. 5 and 6, circuitry through which electrical current may be delivered to the tractor drive motor 12 as there indicated. Power is delivered to the tractor drive motor 12 through three conductors 30, 31, 32. Two of the conductors, namely conductors 30 and 32, are supplied with electrical current through a pair of relays. One relay 34 controls travel of the traveling pneumatic cleaner in a direction considered as forward, while the other relay 35 controls movement of the traveling pneumatic cleaner in a direction referred to as reverse. Sequencing of operation of the relays is governed by the limit switch 16 and by a pair of reversing circuits contained within a housing generally indicated at 36. One of the circuits contained within the housing 36 is more specifically illustrated in FIG. 6. The function of the circuitry of FIG. 6 is to delay energization of the tractor motor 12 for a predetermined interval following actuation of the switch 16 to indicate a reversal in direction of travel of the traveling pneumatic cleaner 10. Two of the circuits indicated in FIG. 6 are provided within the housing 36, one for each of the forward relay 34 and the reverse relay 35.

In operation, as the traveling pneumatic cleaner 10 passes adjacent a location at which one of the switch actuating levers 18, 19 engages a projection 25, 28, 29, the shaft 17 of the switch 16 is rotated through 90 degrees and the switch 16 is changed from one switch connection to the other. Immediately upon changing of the switch 16, the corresponding relay (such as the relay 34 assuming that the cleaner 10 has been moving in a forward direction) is deenergized, interrupting the delivery of electric power to the tractor drive motor 12 and permitting the traveling cleaner 10 to coast to a standstill. After a predetermined short time interval, determined by the values of the circuit components of the circuit of FIG. 6, the other relay 35 (assuming that the change is from forward movement to reverse movement of the traveling cleaner 10) is energized, applying electrical power to the tractor drive motor 12 in such a manner as to reverse its direction of rotation and reverse the direction of travel of the traveling cleaner 10.

As will be understood, the use of the trippable switch 16, together with the timing circuits as illustrated in FIG. 6 differs from the previous practice in which the traveling cleaner was brought to a standstill by contact with an abutment at substantially the same time that the electrical power connections with the tractor drive motor were reversed by the abutment operated switch. Due to the tripping rotation of the switch levers 18, 19, the traveling cleaner of this invention is able to overrun the projection location to such a distance as is appropriate for the "soft" stop-start operation described.

In the drawings and specification, there has been set forth a preferred embodiment of the invention, and although specific terms are employed, they are used in a generic and descriptive sense only and not for purposes of limitation.

That which is claimed is:

1. In a traveling pneumatic cleaner for traversing textile machines and having a tractor drive motor for driving the traveling pneumatic cleaner in forward and reverse directions along a track way and having a control arrangement for reversing the direction of rotation of the tractor drive motor and thus the direction of movement of the traveling cleaner, an improvement in the control arrangement comprising:

switch means operative for controlling the direction of rotation of the tractor drive motor and trippable between forward and reverse positions, and control circuit means operatively interconnected between said switch means and said tractor drive motor and responsive to change of said switch means from one position to the other position to interrupt operation of the tractor drive motor for a predetermined short interval of time, the switch means and control circuit means cooperating for interrupting drive of the traveling cleaner for an interval of time sufficient to permit the traveling cleaner to coast to a standstill before reversing the direction of movement along the track way.

2. Apparatus for cleaning textile mill rooms and comprising:

track way means for extending over a plurality of textile machines;

traveling pneumatic cleaner means supported on said track way means for movement in forward and reverse directions thereon, said traveling pneumatic cleaner means having tractor drive motor means for driving said cleaner means in movement along said track way, reversing trip means mounted on said track way means at at least one predetermined location therealong for signaling at least one location at which a reversal in the direction of movement of said traveling pneumatic cleaner means along said track way means is to occur, switch means mounted on said traveling cleaner means for engagement with said trip means during forward and rearward movement of said traveling cleaner along said track way means and relative to said trip means, said switch means being operable upon engagement with a trip means to change between a first state signaling that the traveling cleaner means should move forwardly and a second state indicating that the traveling cleaner should move rearwardly, and control circuit means operatively interconnecting said switch means and said tractor drive motor means and responsive to a change in state of said switch means for interrupting the delivery of electric power to said tractor drive motor means and after a predetermined short interval of delay energizing the tractor drive motor means to drive the traveling cleaner in an opposite direction.

3. Apparatus according to one of claim 1 or claim 2 wherein said switch means comprises actuation means mounted for rotation through a predetermined angle of rotation and pivoting between forward and reverse positions.

4. Apparatus according to one of claim 1 or claim 2 wherein said control circuit means comprises a signal delay circuit means for delaying for said predetermined time interval the transmission of a signal otherwise effective for reversing the drive of the tractor drive motor.

5. Apparatus according to claim 4 wherein said control circuit means comprises forward relay means operatively connected with said tractor drive motor for energizing said tractor drive motor to rotate in a forward direction, and reverse relay means operatively connected with said tractor drive motor for energizing said tractor drive motor to rotate in a rearward direction, and further wherein said relay means are operatively connected with said switch means and said delay circuit means for promptly deenergizing said tractor drive motor and delayedly reenergizing said tractor drive motor upon change of said switch means.

6. Apparatus according to claim 2 wherein said trip means comprises a projection positioned adjacent said track way means and said switch means comprises actuation means for engaging said projection and for rotation through a predetermined angle of rotation and pivoting between forward and reverse positions upon engagement with said projection.

* * * * *